US011465270B2

(12) United States Patent
Fodera

(10) Patent No.: US 11,465,270 B2
(45) Date of Patent: Oct. 11, 2022

(54) EXPENDABLE HYDRANT WRENCH

(71) Applicant: Sebastian Fodera, Lisle, IL (US)

(72) Inventor: Sebastian Fodera, Lisle, IL (US)

( * ) Notice: Subject to any disclaimer, the term of this patent is extended or adjusted under 35 U.S.C. 154(b) by 279 days.

(21) Appl. No.: 17/026,217

(22) Filed: Sep. 19, 2020

(65) Prior Publication Data

US 2021/0086343 A1 Mar. 25, 2021

Related U.S. Application Data

(60) Provisional application No. 62/903,772, filed on Sep. 21, 2019.

(51) Int. Cl.
*B25G 1/04* (2006.01)
*B25B 13/50* (2006.01)

(52) U.S. Cl.
CPC ..... *B25G 1/043* (2013.01); *B25B 13/50* (2013.01)

(58) Field of Classification Search
CPC ..... B25G 1/005; B25G 1/043; B25B 13/50
See application file for complete search history.

(56) References Cited

U.S. PATENT DOCUMENTS

| | | | | |
|---|---|---|---|---|
| 2,520,652 | A * | 8/1950 | Pfauser | B25G 1/005 74/544 |
| 5,285,702 | A * | 2/1994 | Hillinger | B25G 1/043 403/109.8 |
| 5,428,853 | A | 7/1995 | Menke | |
| 6,220,124 | B1 | 4/2001 | Perkins | |
| 6,298,754 | B1 | 10/2001 | Brown | |
| 6,339,979 | B1 * | 1/2002 | Chiang | B25G 1/063 81/177.2 |
| 6,899,001 | B1 | 5/2005 | Sanders | |
| 10,058,720 | B2 | 8/2018 | Weinmeister | |
| 2018/0245319 | A1 | 8/2018 | Deubler, IV | |

* cited by examiner

*Primary Examiner* — David B. Thomas
(74) *Attorney, Agent, or Firm* — Michael C. Balaguy

(57) ABSTRACT

A fire hydrant wrench includes a wrench-head able to fasten to the pentagonal interface of a fire-hydrant and a handle able to be selectively extended or retracted by a user. The wrench includes a cylindrical rod which may be contained by and telescopes within a tubular handle. A cap on a handle-end of the tubular handle prevents the cylindrical rod from leaving the handle in one direction, while a collar affixed externally to the cylindrical rod prevents it from leaving the handle in the opposite direction. The tool-head containing the wrench is affixed to a tool-end of the cylindrical rod which protrudes from the tubular handle in all positions.

8 Claims, 5 Drawing Sheets

EXPENDABLE HYDRANT WRENCH

CROSS-REFERENCE TO RELATED APPLICATION(S)

The present application is related to and claims priority to U.S. Provisional Patent Application No. 62/903,772 filed Sep. 21, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of hand tools of existing art and more specifically relates to firefighting tool.

RELATED ART

Most fire hydrants are seldom opened, and often when firefighters need to open a hydrant, they have difficulty opening the pentagonal bolt on the hydrant with a standard hydrant wrench. A common practice for firefighters is to carry a breaker bar separately in their fire truck to apply extra leverage to a hydrant wrench when necessary. This is an unsatisfactory solution. The breaker bar may be easily misplaced and unobtainable in an emergency. Further, carrying the tool in what is effectively two separate pieces reduces the firefighter's response time, and is a logistical hassle when trying to store or carry the two tools separately. Accordingly, there is perceived a need for a solution to provide a fire hydrant wrench which is less cumbersome to store and carry than a two-piece solution, and also provides sufficient leverage for opening stuck fire hydrants.

U.S. Pat. No. 6,899,001 to Alan Sanders et al. relates to a firefighter's wrench. The described firefighter's wrench includes a multiple component wrench which is adapted for use to attach and disconnect fire hose and hydrant coupling using this singular tool in lieu of several tools currently used by firefighters. The wrench has a sliding portion and a receiver portion presented as one tool, yet allowing multiple wrenches adapted for use on Storz and spanner hose couplings, rocker lug couplings, water meter shutoff valves, gas cock valves, pentagonal nuts and square nuts, and includes a multiple ratchet mechanism with multiple removable ratchets adapted to a variety of different nuts encountered on the multiple hydrants installed in various municipalities. The wrench is also extendable to provide additional leverage during use, the wrench further capable of separation forming two independent wrenches.

SUMMARY OF THE INVENTION

In view of the foregoing disadvantages inherent in the known firefighting tool art, the present disclosure provides a novel extendable hydrant wrench. The general purpose of the present disclosure, which will be described subsequently in greater detail, is to provide an extendable hydrant wrench.

A hydrant fire wrench includes a wrench-head able to fasten to the pentagonal interface of a fire-hydrant and a handle able to be selectively extended or retracted by a user. The wrench includes a cylindrical rod which may be contained by and telescopes within a tubular handle. A cap on a handle-end of the tubular handle prevents the cylindrical rod from leaving the handle in one direction, while a collar affixed externally to the cylindrical rod prevents it from leaving the handle in the opposite direction. The tool-head containing the wrench is affixed to a tool-end of the cylindrical rod which protrudes from the tubular handle in all positions.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an extendable hydrant wrench, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a firefighting tool and more particularly to an extendable hydrant wrench as used to improve the ease of opening fire hydrants.

Generally, the disclosed hydrant wrench provides users with a modified hydrant wrench featuring an extension built into the handle to act as a breaker bar. The wrench handle may be almost doubled in length during use to provide extra leverage on hydrants which are difficult to open. This effectively eliminates the need for firefighters to carry a separate breaker bar with them, as is often done to accompany currently marketed wrenches.

Referring now more specifically to the drawings by numerals of reference, there is shown in FIGS. 1-5, various views of a hydrant wrench 100.

Figure 1:
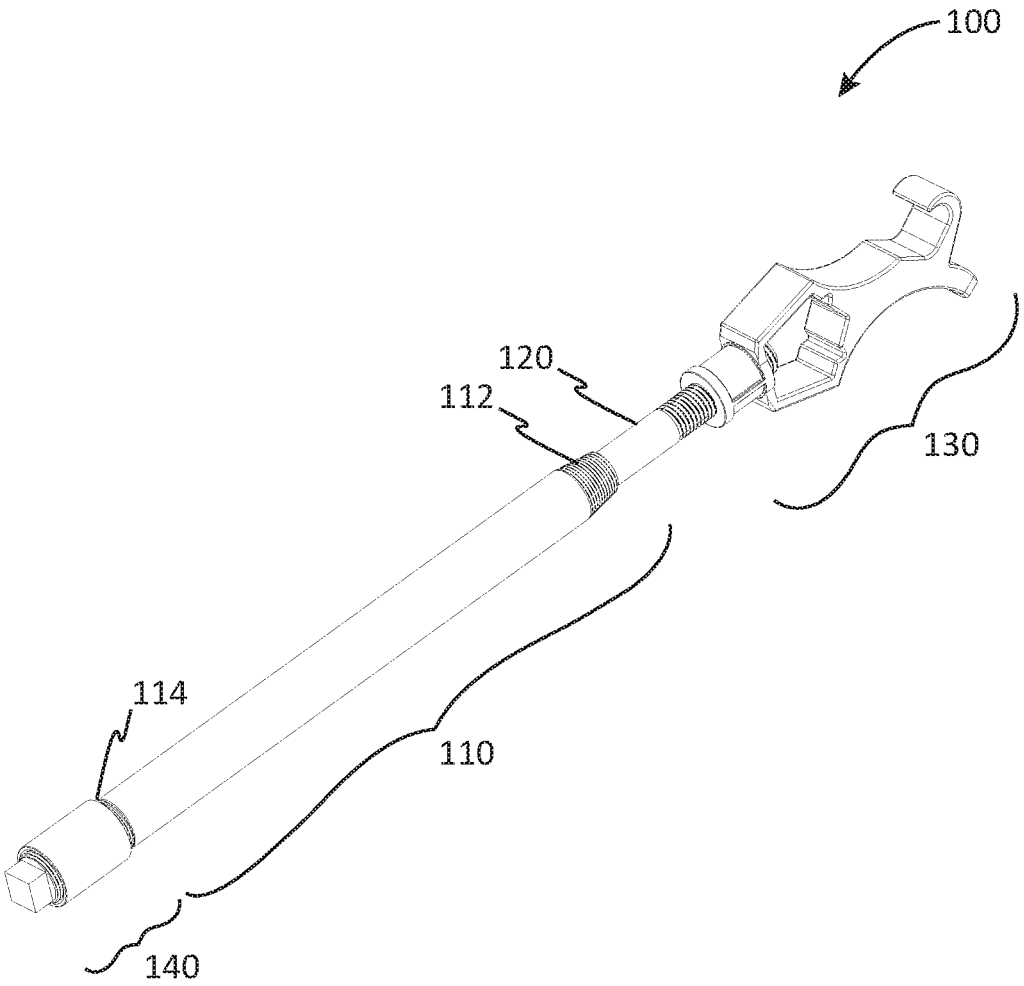
FIG. 1 is a perspective view of the hydrant wrench, according to an embodiment of the disclosure.

FIG. 1 shows a hydrant wrench during an 'in-use' condition, according to an embodiment of the present disclosure. Here, the hydrant wrench may be beneficial for use by a user to open or close a fire hydrant by manipulating a pentagonal bolt on the hydrant. The hydrant wrench 100 may include tubular handle 110, cylindrical rod 120, tool-head 130, and cap 140. As shown, tubular handle 110 is hollow and able to contain cylindrical rod 120, such that cylindrical rod may reciprocate within tubular handle 110. Tubular handle 110 is able to be grasped by a user to manipulate the hydrant wrench 100. Cap 140 closes tubular handle 110 at second-open end 114 of tubular handle 110 to prevent cylindrical rod 120 from passing out of second-open end 114. However, cylindrical rod 120 may telescope past first-open end 112. Cylindrical rod 120 may terminate in tool-head 130.

Figure 2:
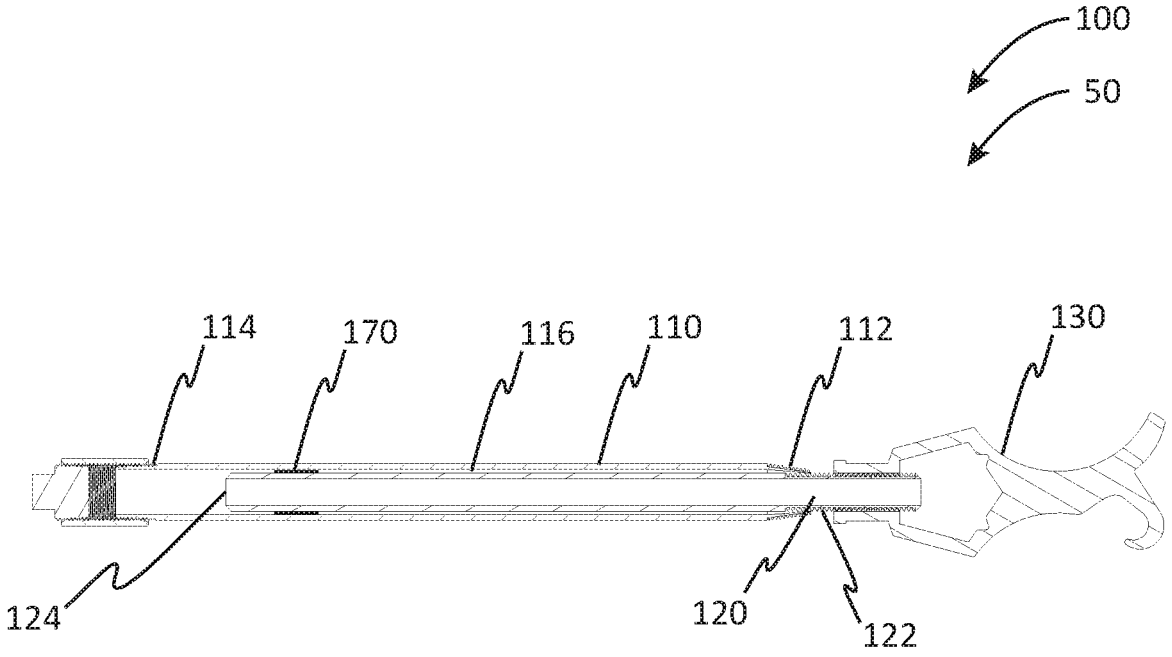
FIG. 2 is a perspective view of the hydrant wrench of FIG. 1 in a collapsed-condition, according to an embodiment of the present disclosure.

FIG. 2 shows the hydrant wrench of FIG. 1, according to an embodiment of the present disclosure. Hydrant wrench 100 is illustrated in a collapsed condition 50. As illustrated, each of first-open end 112 and second-open end 114 of tubular handle 110 may be externally threaded. Tubular handle 116 may be further defined by bore 116 extending from first-open end 112 to second-open end 114. Bore 116 is preferably cylindrical and non-tapering. Cylindrical rod 120 may be defined by tool-end 122 and handle-end 124. Hand-end 124 may be opposite of tool-end 122. Cylindrical rod 120 may of no greater external diameter than bore 116. Preferably, cylindrical rod 120 is slightly smaller than bore 116; small enough to prevent free sliding of cylindrical rod 120, but not so small so that cylindrical rod 120 can pitch and rattle within bore 116. Tool-head 130 may be affixed to tool-end 122 of cylindrical rod 120, preferably by threading.

Collar 170 may be affixed to and may circumscribe cylindrical rod 120. Collar 170 may be circular is shape, and of no greater external diameter than bore 116, collar 170 being of greater external diameter than cylindrical rod 120. In this way, collar 170 may impinge upon and inside of first-end 112 of tubular handle 110, so that a maximum extension of cylindrical rod 120 relative to tubular handle 110 is reached, and cylindrical rod 120 does not fall out of tubular handle 110 in use. Accordingly, first-open end 112 is of lesser diameter than collar 170, such that as cylindrical rod 120 slides within bore 116, collar 170 may impinge upon and not pass first-open end 112. Cap 140 may be internally threaded and fastenable to second-open end 114, such that cap 140 closes second-open end 114 when cap 140 is fastened to second-open end 114, and such that when cylindrical rod 120 is installed within bore 116 and cap 140 is fastened to second-open end 114, cylindrical rod 120 is captive within bore 116, and may telescope within bore 116 until cylindrical rod 120 impinges upon cap 140 and until collar 170 impinges upon first-open end 112.

Figure 3:
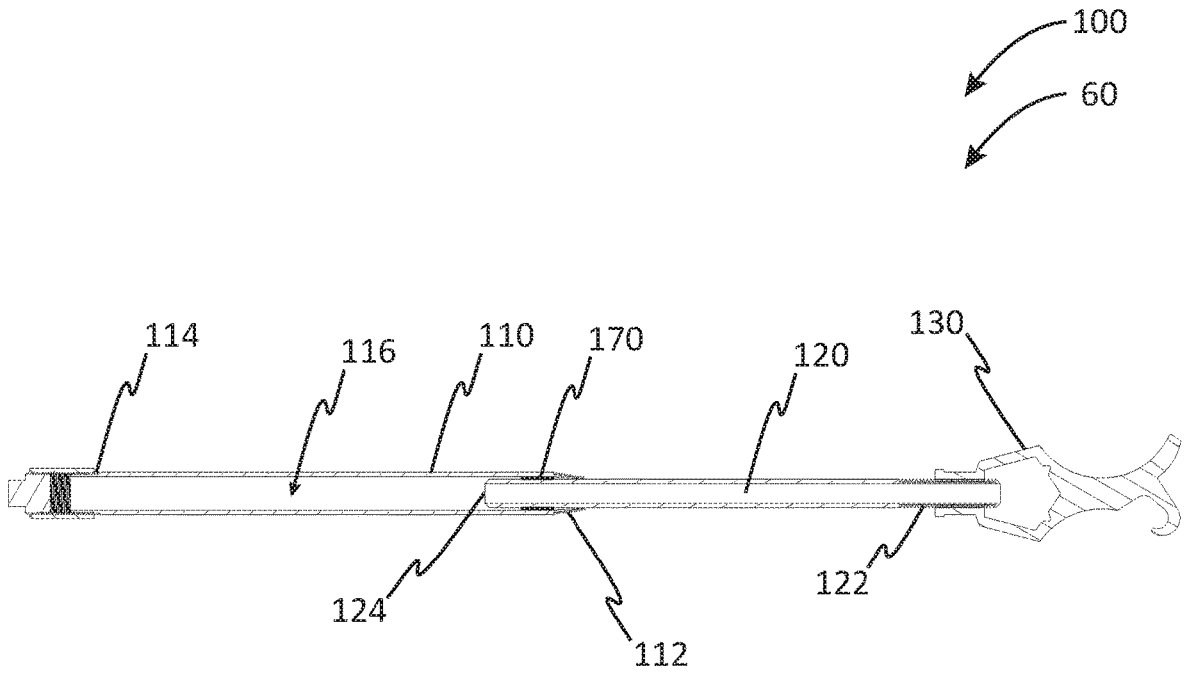
FIG. 3 is a perspective view of the hydrant wrench of FIG. 1 in an extended-position, according to an embodiment of the present disclosure.

FIG. 3 is a perspective view of the hydrant wrench of FIG. 1, according to an embodiment of the present disclosure. Here, hydrant wrench 100 is illustrated in an extended condition 60. Cylindrical rod 120 can be seen maximally extended from tubular handle 110, with collar 170 at handle-end 124 impinging upon and inside of first-end 112. As a result, tool-head 130 and tool-end 122 are maximally distant from tubular handle 110. In this condition, bore 116 is largely unoccupied. At an opposite end, second-end 114 closes tubular handle 110.

Figure 4:
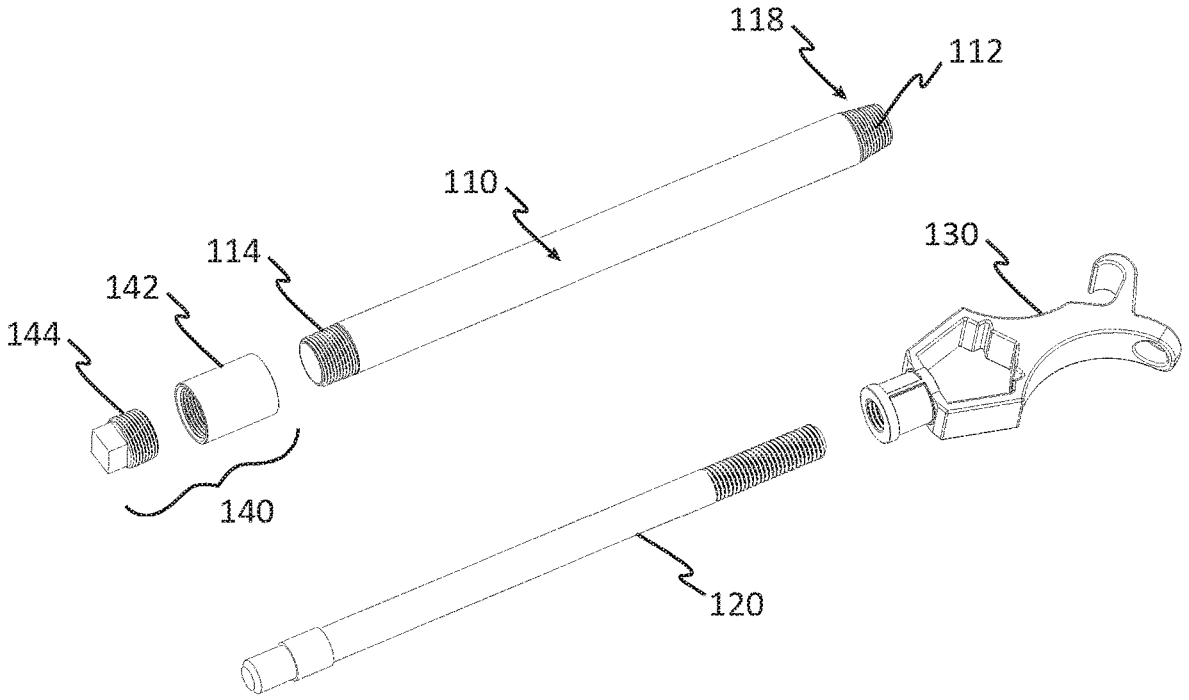
FIG. 4 is an exploded view of the hydrant wrench of FIG. 1, according to an embodiment of the present disclosure.

FIG. 4 is an exploded view of the hydrant wrench of FIG. 1, according to an embodiment of the present disclosure. As shown, cap 140 may further be divided into sleeve 142 and plug 144 in some embodiments. Plug 144 may be threadably fastenable into sleeve 142 to close second-openable end 114 of tubular handle 110. Plug 142 may include a square tool-interface as illustrated. Cylindrical rod 120 is removable from tubular handle 110 when tool-head 130 is detached from cylindrical rod 120 and cap 140 is detached from tubular handle 110. However, if tool-head 130 is attached, it impinges upon first-end 112, preventing removal of cylindrical rod 120 from tubular handle 110. As illustrated, first-end 112 may have a taper 118 to enact this restriction upon which both tool-end 130 and collar 170 (FIG. 3) may impinge. In some embodiments, first-end 112 having taper 118 may be welded to tubular-handle 110. Likewise, in some embodiments plug 144 and sleeve 142 may be welded together.

Figure 5:
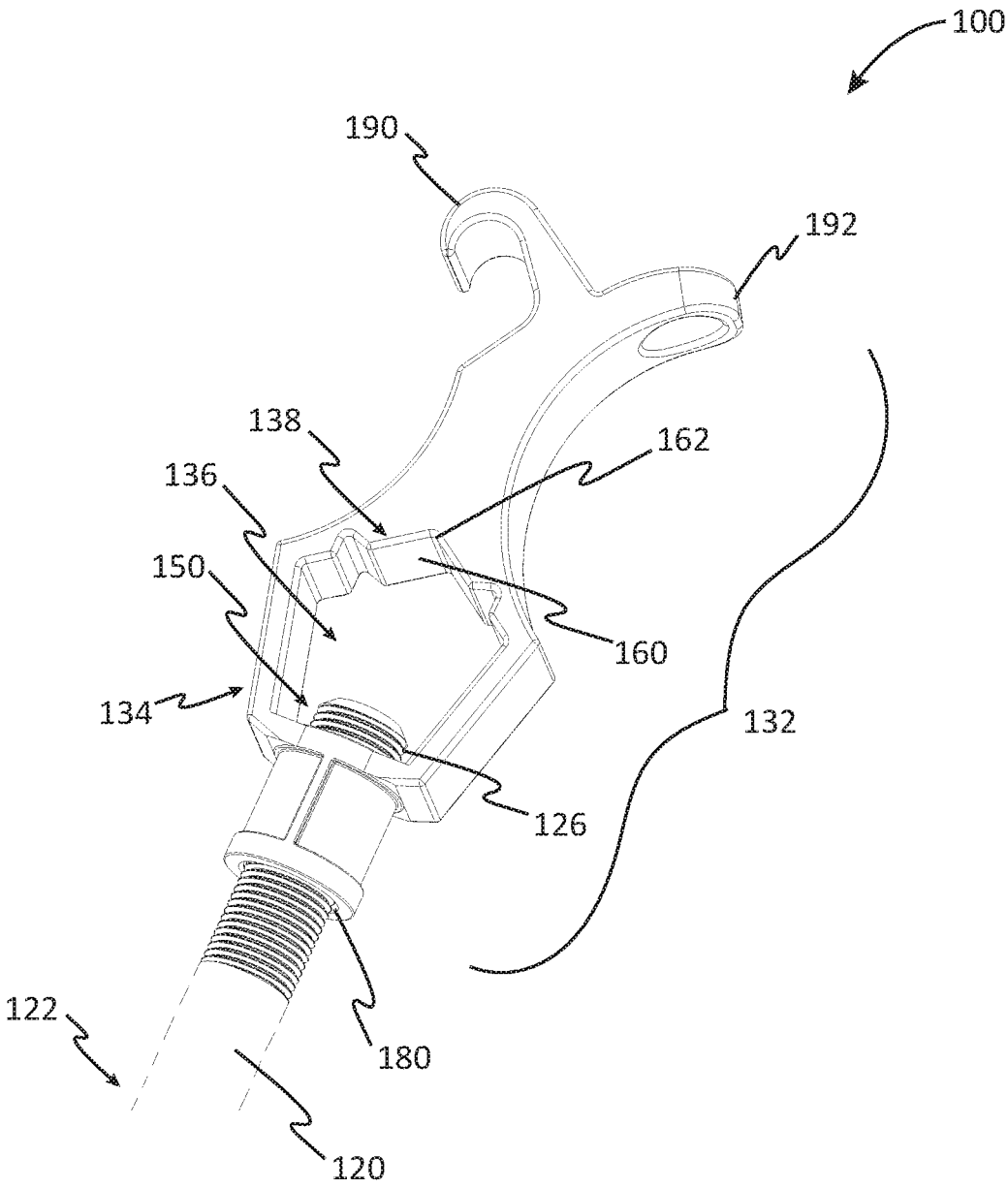
FIG. 5 is a perspective view of the tool-head of the hydrant wrench of FIG. 1, according to an embodiment of the present disclosure.

FIG. 5 is a perspective view of the hydrant wrench of FIG. 1, according to an embodiment of the present disclosure. As shown, tool-head 130 (FIG. 4) may include adjustable pentagonal closed-wrench 132 having frame 134, aperture 136 within frame 134, two-faced wrench-jaw 138 including two faces 160 separated by an angulation of one-hundred-and-eight degrees, and threadably advanceable wrench-jaw 150 able to be advanced towards and alternatively retarded from nexus 162 of the two faces 160 of two-faced wrench-jaw 138. Together, threadably advanceable wrench-jaw 150 and the two faces 160 may engage three out of five faces of a pentagonal bolt. Advancement or retarding of threadably advanceable wrench-jaw 150 may allow adjustment for bolts of different sizes. Threadably-advanceable wrench-jaw 150 may be an externally threaded stud integral 126 to tool-end 122 of cylindrical rod 120. Frame 134 comprises an internally-threaded tool-bore 180 (or internally-threaded bore) able to accept externally threaded stud 126. Externally threaded stud may be cut into tool-end 122 of cylindrical rod 120, as shown. Two-faced wrench-jaw 138 may be integral to frame 134, such that the two faces 160 of two-faced wrench-jaw 138 face into aperture 136. Yet further, adjustable pentagonal closed-wrench 132 may include hook 190 and loop 192, preferably disposed distally to tool-bore 180.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hydrant wrench comprising:

a tubular handle having a first-open end, a second-open end, the second-open end being externally threaded, and a bore extending from the first-open end to the second-open end;

a cylindrical rod having a tool-end and a handle-end opposite the tool-end, the cylindrical rod being of no greater external diameter than the bore;

a tool-head affixed to the tool-end of the cylindrical rod, the tool-head comprising an adjustable pentagonal closed-wrench having a frame, an aperture within the frame, a two-faced wrench-jaw including two faces separated by an angulation of one-hundred-and-eight degrees, a threadably advanceable wrench-jaw able to be advanced towards and alternatively retarded from a nexus of the two faces of the two-faced wrench-jaw;

a collar affixed to and circumscribing the cylindrical rod, the collar being circular is shape, the collar being of no greater external diameter than the bore, the collar being of greater external diameter than the cylindrical rod;

a cap which is internally threaded and fastenable to the second-open end, the cap closing the second-open end when the cap is fastened to the second-open end;

wherein the first-open end is of lesser diameter than the collar, such that as the cylindrical rod slides within the bore, the collar may impinge upon and not pass the first-open end;

such that when the cylindrical rod is installed within the bore and the cap is fastened to the second-open end, the cylindrical rod is captive within the bore, and may telescope within the bore until the cylindrical rod impinges upon the cap and until the collar impinges upon the first-open end.

2. The hydrant wrench of claim 1, wherein the threadably-advanceable wrench-jaw is an externally threaded stud integral to the tool-end of the cylindrical rod.

3. The hydrant wrench of claim 2, wherein the frame comprises an internally-threaded bore able to accept the externally threaded stud.

4. The hydrant wrench of claim 1, wherein the two-faced wrench-jaw is integral to the frame, such that the two faces of the two-faced wrench-jaw face into the aperture.

5. The hydrant wrench of claim 1, wherein the tool-head further comprises a hook.

6. The hydrant wrench of claim 1, wherein the tool-head further comprises a loop.

7. The hydrant wrench of claim 1, wherein the cap comprises an externally threaded plug and an internally threaded sleeve, such that the internally threaded sleeve is able to couple the externally threaded plug to the second-open end of the tubular handle.

8. An extendable hydrant wrench comprising:

a tubular handle having a first-open end, a second-open end, the second-open end being externally threaded, and a bore extending from the first-open end to the second-open end;

a cylindrical rod having a tool-end and a handle-end opposite the tool-end, the cylindrical rod being of no greater external diameter than the bore;

a tool-head affixed to the tool-end of the cylindrical rod, the tool-head comprising an adjustable pentagonal closed-wrench having a frame, an aperture within the frame, a two-faced wrench-jaw including two faces separated by an angulation of one-hundred-and-eight degrees, a threadably advanceable wrench-jaw able to be advanced towards and alternatively retarded from a nexus of the two faces of the two-faced wrench-jaw;

a collar affixed to and circumscribing the cylindrical rod, the collar being circular is shape, the collar being of no greater external diameter than the bore, the collar being of greater external diameter than the cylindrical rod;

a cap which is internally threaded and fastenable to the second-open end, the cap closing the second-open end when the cap is fastened to the second-open end;

wherein the first-open end is of lesser diameter than the collar, such that as the cylindrical rod slides within the bore, the collar may impinge upon and not pass the first-open end;

such that when the cylindrical rod is installed within the bore and the cap is fastened to the second-open end, the cylindrical rod is captive within the bore, and may telescope within the bore until the cylindrical rod impinges upon the cap and until the collar impinges upon the first-open end;

wherein the threadably-advanceable wrench-jaw is an externally threaded stud integral to the tool-end of the cylindrical rod;

wherein the frame comprises an internally-threaded bore able to accept the externally threaded stud;

wherein the two-faced wrench-jaw is integral to the frame, such that the two faces of the two-faced wrench-jaw face into the aperture;

wherein the tool-head further comprises a hook;

wherein the tool-head further comprises a loop; and wherein the cap comprises an externally threaded plug and an internally threaded sleeve, such that the internally threaded sleeve is able to couple the externally threaded plug to the second-open end of the tubular handle.

* * * * *